US007794149B2

(12) United States Patent
Wilkes

(10) Patent No.: US 7,794,149 B2
(45) Date of Patent: Sep. 14, 2010

(54) CONTAINER OF SELECTIVELY EXPANDED PLASTIC FILM WITH FITMENT

(75) Inventor: Kenneth R. Wilkes, Asheville, NC (US)

(73) Assignee: Smart Bottle Inc., Ashville, NC (US)

( * ) Notice: Subject to any disclaimer, the term of this patent is extended or adjusted under 35 U.S.C. 154(b) by 1454 days.

(21) Appl. No.: 11/140,880

(22) Filed: May 31, 2005

(65) Prior Publication Data

US 2006/0266728 A1 Nov. 30, 2006

(51) Int. Cl.
*B65D 30/20* (2006.01)
*B65D 33/10* (2006.01)
*B65D 30/16* (2006.01)

(52) U.S. Cl. ..... 383/120; 383/104; 383/906; 383/907

(58) Field of Classification Search ..... 215/40; 383/80, 104, 124, 120, 33, 906, 907, 123; 220/675, 677, 678; 229/89, 115, 406
See application file for complete search history.

(56) References Cited

U.S. PATENT DOCUMENTS 2,682,974 A * 7/1954 Smith ..... 222/107
3,072,959 A 1/1963 Leeds, et al.
4,415,085 A 11/1983 Clarke et al.
4,458,811 A * 7/1984 Wilkinson ..... 206/219
4,484,904 A 11/1984 Fowler
4,711,359 A * 12/1987 White et al. ..... 215/11.1
4,836,691 A * 6/1989 Suzuki et al. ..... 383/80
5,366,791 A 11/1994 Carr et al.
5,637,167 A 6/1997 Krishnakumar et al.
5,743,988 A 4/1998 Accorsi
5,971,613 A 10/1999 Bell
6,116,440 A 9/2000 Zaksenberg et al.
6,126,315 A 10/2000 Ickikawa et al.
6,193,416 B1 * 2/2001 Kawamata et al. ..... 383/104
6,265,038 B1 * 7/2001 Frisk ..... 428/34.7
6,468,377 B1 * 10/2002 Sperko et al. ..... 156/229
6,667,081 B1 12/2003 Aoki et al.
D489,993 S 5/2004 Wilkes
6,832,852 B2 12/2004 Wilkes
6,984,354 B2 1/2006 Shelby et al.
7,147,597 B2 12/2006 Wilkes
7,245,853 B2 * 7/2007 Muramatsu et al. ..... 399/120

(Continued)

FOREIGN PATENT DOCUMENTS

JP 9104445 4/1997

(Continued)

*Primary Examiner*—Sue A Weaver

(57) ABSTRACT

A container including a fitment providing a closure and a plurality of panels of plastic film. Each of the panels has a pair of opposing longitudinal edges with each edge joined to a longitudinal edge of an adjacent panel to form an outwardly extending seam. The panels collectively form a tube-like structure. A first end of the tube-like structure is sealed to the fitment. An opposing second end of the tube-like structure is closed by seams joining adjacent panels. A first portion of each of the panels adjacent the second end of the tube-like structure is expanded such that the first portion of each of the panels is not flat. A second portion of each of the panels between the first end and the second end is left substantially unexpanded such that the second portion of each of the panels is substantially flat.

7 Claims, 4 Drawing Sheets

U.S. PATENT DOCUMENTS

| | | | | |
|---|---|---|---|---|
| 7,284,681 | B2 * | 10/2007 | Hagihara | 222/107 |
| 2002/0031627 | A1 | 3/2002 | Van Schaftingen | |
| 2002/0141663 | A1 * | 10/2002 | Edwards et al. | 383/10 |
| 2002/0190108 | A1 | 12/2002 | Hermodsson | |
| 2003/0012851 | A1 * | 1/2003 | Kuge et al. | 426/85 |
| 2005/0123222 | A1 | 6/2005 | Wilkes | |

FOREIGN PATENT DOCUMENTS

| | | |
|---|---|---|
| JP | 11091014 | 4/1999 |
| JP | 2001240083 | 9/2001 |
| JP | 2003002341 | 1/2003 |

* cited by examiner

CONTAINER OF SELECTIVELY EXPANDED PLASTIC FILM WITH FITMENT

BACKGROUND OF THE INVENTION

The billions of pounds of plastic products and packaging produced in this country every year create numerous concerns. At every step in the production of plastics, resources are consumed and waste is produced. Plastics are made from finite, nonrenewable petroleum and natural gas raw materials. Reducing the amount of plastic needed to make a plastic container, such as a bottle or jar, has many benefits.

While the amount of plastic used in making a plastic container can be reduced by thinning the walls of the container, this can create structural problems with the container. Thin walls also increase the oxygen permeability of the container. That may adversely affect the ability of the container to protect and preserve the contents, particularly for foodstuffs.

Container can be made from plastic films which offer the possibility of producing containers with very thin walls that provide a good oxygen barrier. However, making containers from plastic films creates a number of structural challenges.

SUMMARY OF THE INVENTION

A container including a fitment providing a closure and a plurality of panels of plastic film. Each of the panels has a pair of opposing longitudinal edges with each edge joined to a longitudinal edge of an adjacent panel to form an outwardly extending seam. The panels collectively form a tube-like structure. A first end of the tube-like structure is sealed to the fitment. An opposing second end of the tube-like structure is closed by seams joining adjacent panels. A first portion of each of the panels adjacent the second end of the tube-like structure is expanded such that the first portion of each of the panels is not flat. A second portion of each of the panels between the first end and the second end is left substantially unexpanded such that the second portion of each of the panels is flat.

DETAILED DESCRIPTION OF THE INVENTION

The present invention provides a container made largely from a plastic film and thereby substantially reducing the amount of plastics in the container. The films may be chosen to provide a good oxygen barrier. The structure of the container provides for a container that is stable when filled and amenable to an attractive graphic treatment.

Film as used herein refers to a thin, generally flexible, sheet of plastic suitable for packaging. The film may be of organic polymers that can be classified by how permeable they are to gases (e.g., oxygen or carbon dioxide) and moisture vapor. Those organic polymers that significantly restrict the ability of gases to pass through them are referred to as gas barrier polymers or high barrier polymers. The use of high barrier polymers is very important in the packaging of certain foods and beverages, which require protection from oxygen and moisture. Vinylidene chloride based polymers (PVDC) and copolymers are examples of suitable high barrier polymers for films for use in the present invention. Perhaps the most familiar examples of the vinylidene chloride based polymers used in packaging are commercial Saran® products. Other high oxygen barrier polymers may be used, such as ethylene vinyl alcohol (EVOH) copolymers. However, EVOH copolymers lack the moisture resistance properties associated with vinylidene chloride based polymers, and therefore, EVOH copolymers may be combined with additional moisture barrier polymers for use in the present invention. Packaging comprising high gas barrier polymers, such as PVDC and EVOH, may be inadequate to protect certain packaged oxygen sensitive products, such as beer and juice, from environmental oxygen. Modified organic polymers may be used in the present invention to enhance oxygen barrier properties. Modifications may include chemical modification of organic polymers, such as fluoridation or sulfonation of organic polymers.

Figure 1:
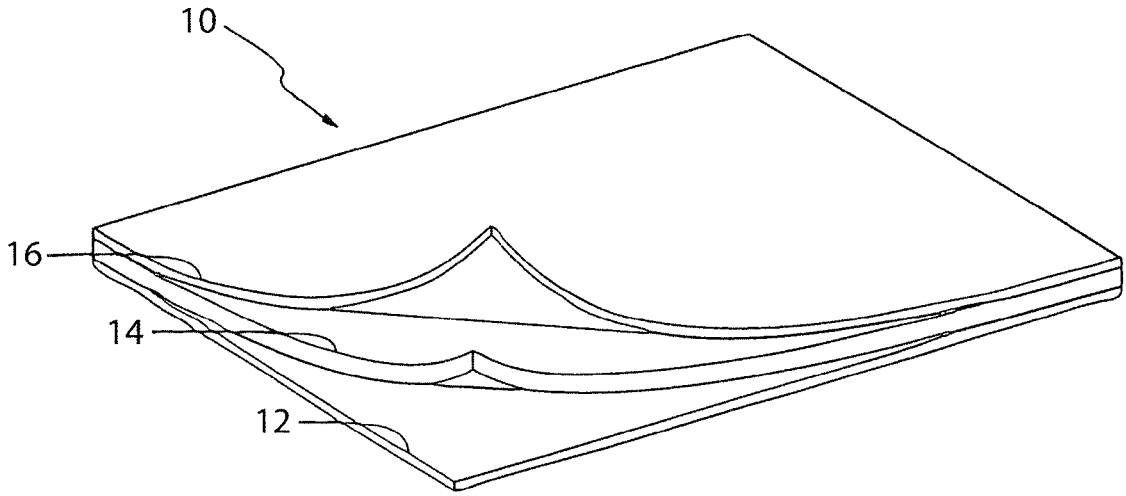
FIG. 1 is a perspective view of a laminate film that may be used in an embodiment of the present invention.

The film used in the present invention may be a laminate of several component films selected to provide a combination of desirable properties. For example, as shown in FIG. 1, the laminate film 10 may include a film layer 12 chosen to provide good seaming qualities for joining sheets. Another included film layer 14 may be a high barrier layer, perhaps opaque and located within the laminate. Another included film layer 16 may be an "overwrap" layer that forms the exterior surface of the container and provides a protective and attractive surface.

Figure 3:
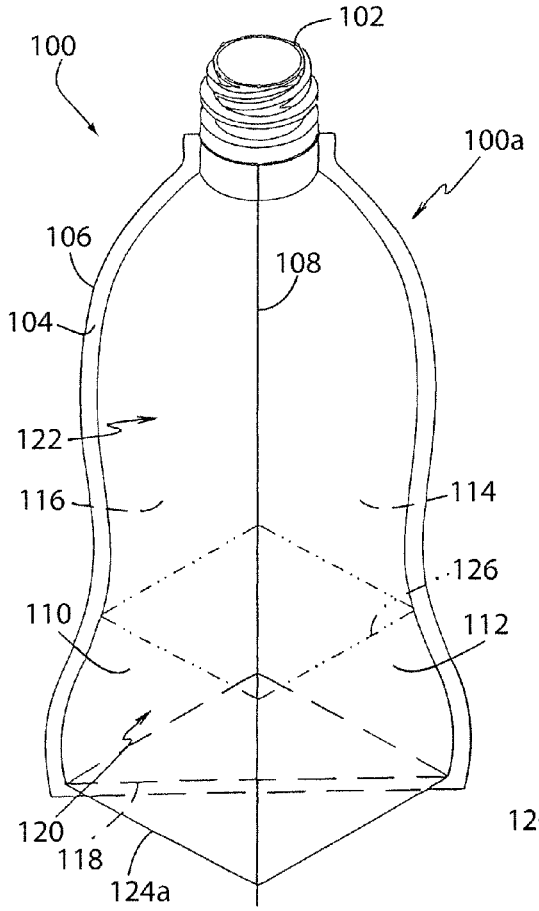
FIG. 3 is a perspective view of a container in an intermediate stage of construction.
Figure 5:
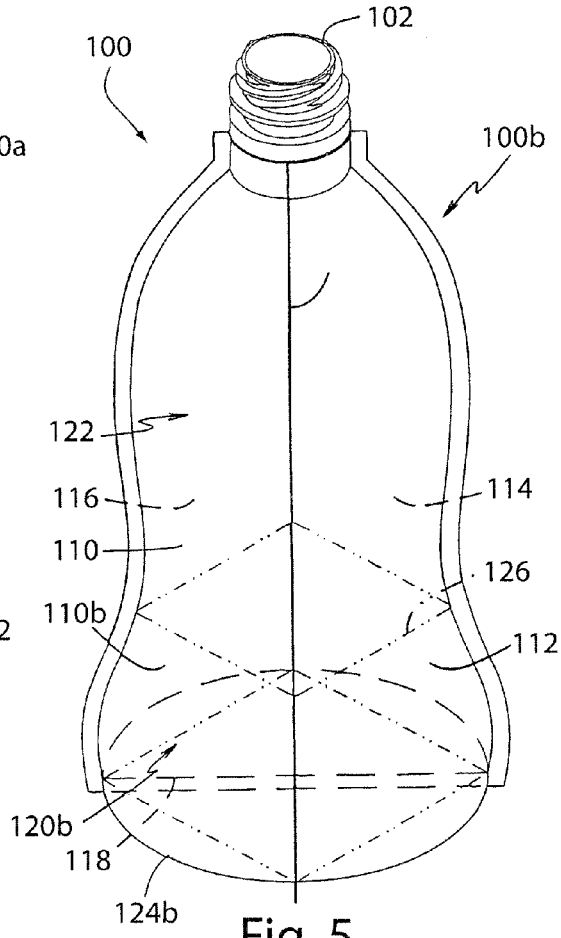
FIG. 5 is a perspective view of the container of FIG. 3 as completed to embody the invention.
Figure 4:
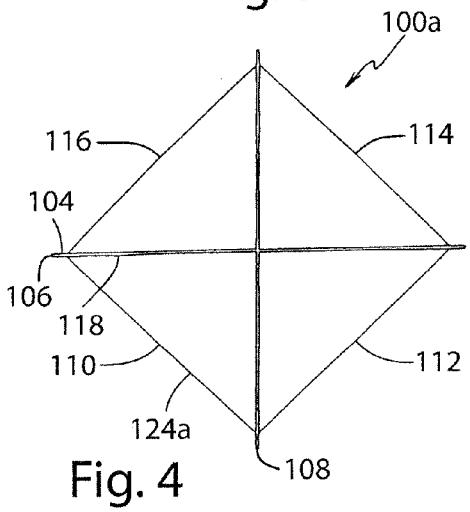
FIG. 4 is a bottom view of the container of FIG. 3.
Figure 6:
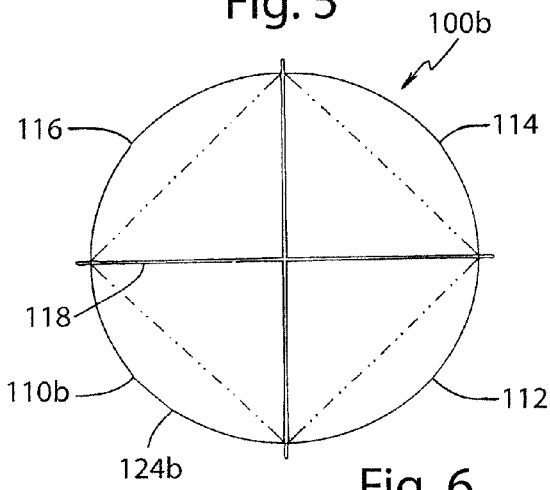
FIG. 6 is a bottom view of the container of FIG. 5.

FIGS. 3 through 6 illustrate a container, more particularly a bottle, that embodies the invention. FIGS. 3 and 4 illustrate a partially fabricated bottle 100*a* and FIGS. 5 and 6 illustrate the same bottle 100*b* fully fabricated. A fitment 102 provides a substantially rigid opening for the container. The fitment may provide a resealable closure or a single use closure. The fitment may allow the container to be closed and opened and may provide a stable opening for accessing the contents of the container. The fitment may be of any of a variety of materials and fabricated by any of a variety of means.

The body of the container 100 is formed from a plurality of panels of plastic film, four panels 110, 112, 114, 116 for the embodiment shown in FIGS. 3-6. Each of the panels 110 has a pair of opposing longitudinal edges 106 108. Each longitudinal edge of each panel is joined, such as by plastic welding, to a longitudinal edge of an adjacent panel to form an outwardly extending seam 104. The panels 110, 112, 114, 116 collectively form a tube-like structure. A first end of the tube-like structure is sealed to the fitment 102, such as by plastic welding. An opposing second end of the tube-like structure is closed by seams 118 joining adjacent panels.

A first portion 120 of each of the panels 110 adjacent the second end of the tube-like structure is expanded, such as by thermoforming. The thermoforming may be carried out by placing the container in a mold and filling the container with a heated fluid, such as heated air, to selectively expand the panels to fill the mold. Where the container is to be filled with a suitable fluid product, heated product may be used to accomplish the thermoforming.

As a result of the expansion, the first portion 120*b* of each of the panels 110*b* is not flat. However, a second portion 122 of each of the panels 110*b* between the first end and the second end is left substantially unexpanded such that the second portion of each of the panels remains substantially flat as it was prior to the expansion process. Phantom line 126 shows the general boundary between the first portion 120 below and the second portion 122 above. It will be observed that the phantom line 126 is essentially unchanged by the expansion process. The term "substantially unexpanded" is used to mean that the plastic film is not intentionally expanded although the film may be slightly expanded due to normal tolerances of the mold and the assembly of the unexpanded bottle, such as the mold being slightly oversize or the plastic film assembly being slightly undersized.

Prior to expansion the fold 124*a* that forms the periphery of the bottom of the container 100*a*, may be generally rectangular. Following expansion the fold 124*b* forming the periphery, may be elliptical or some other rounded shape. The expansion may provide a bottom for the container that is less susceptible to buckling. The expansion may tend to minimize the outwardly extending seams 104 and thereby provide a container bottom that is better suited for standing on a flat surface.

Figure 7:
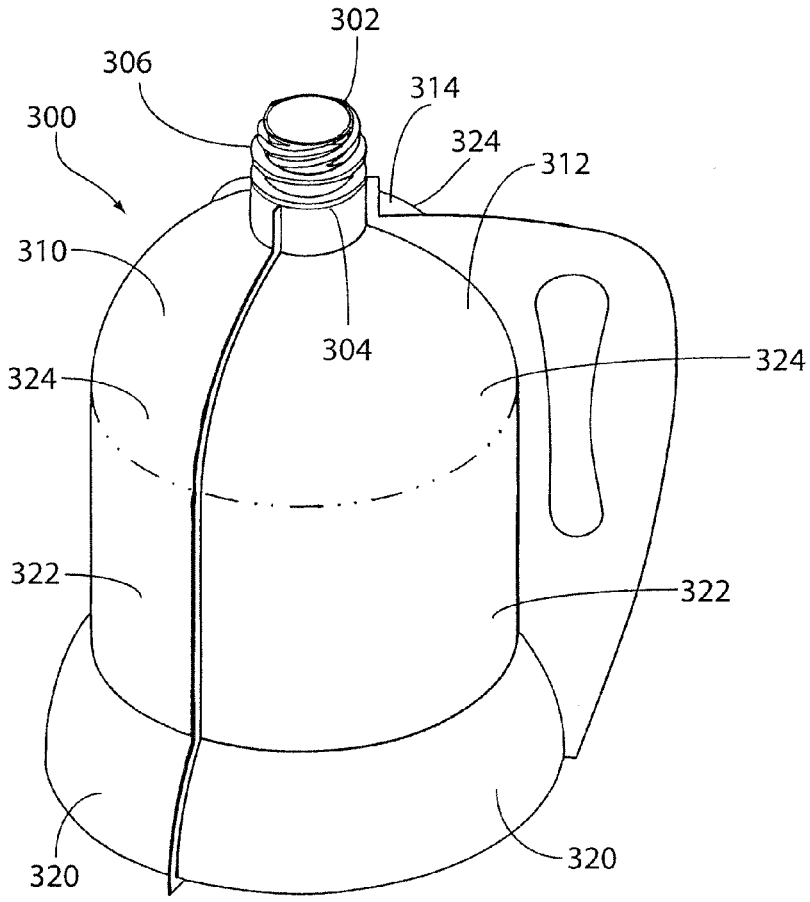
FIG. 7 is a perspective view of another container that embodies the invention.
Figure 8:
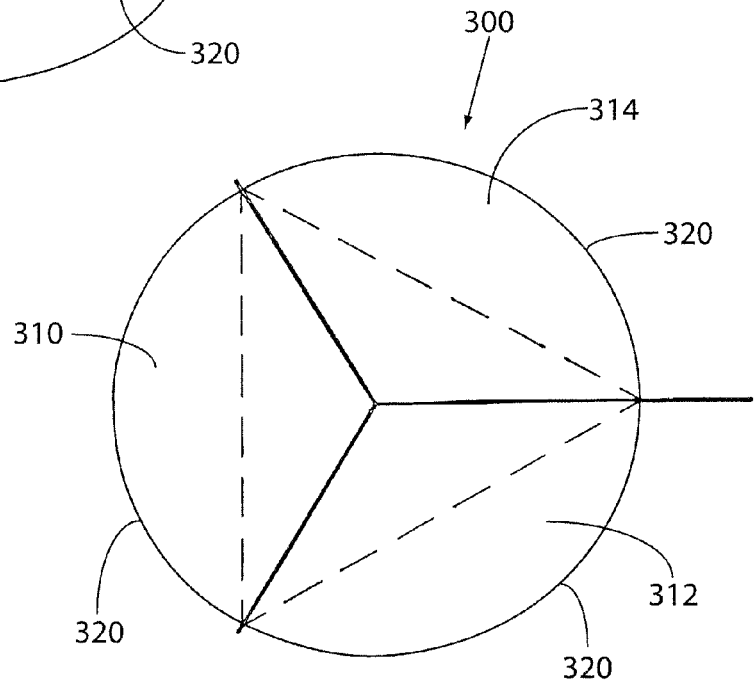
FIG. 8 is a bottom view of the container of FIG. 7.
Figure 10:
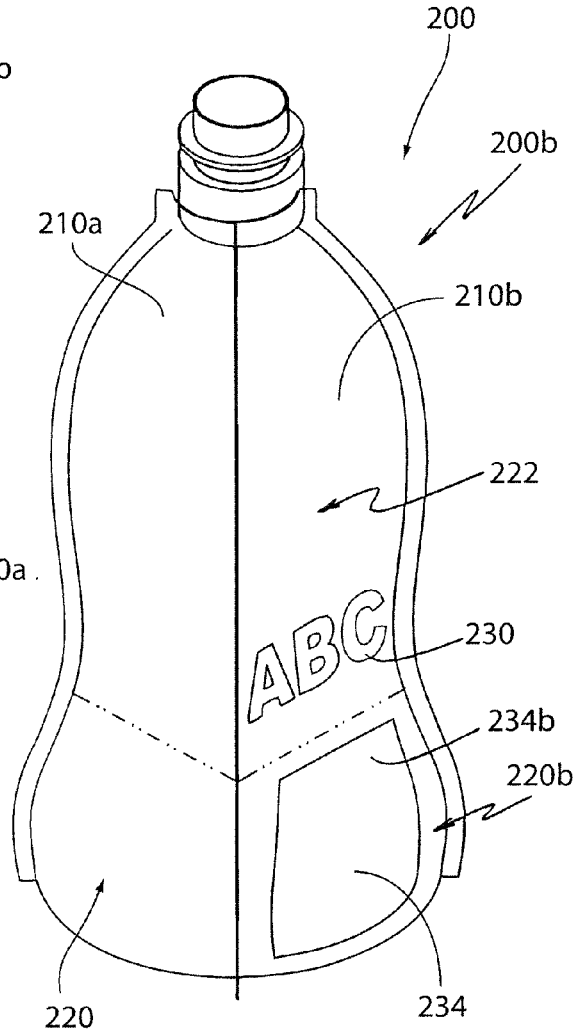
FIG. 10 is a perspective view of the container of FIG. 9 as completed to embody the invention.

In another embodiment as illustrated by FIGS. 7 and 8, the container 300 may be constructed with three panels of plastic film 310, 312, 314. In this embodiment the container is expanded such that a first portion of each of the panels 320 of the container at the end opposite the fitment 302 is expanded to form a generally cylindrical base. As seen in FIG. 10, the generally triangular periphery of the unexpanded container indicated by dashed lined may be formed into a generally circular periphery. The container may include a third portion of each of the panels 324 adjacent the fitment 302 that is expanded such that the third portion of each of the panels is not flat. This may provide a generally hemispherical top portion for the container 300. The expansion of the third portion 324 may provide a more stable structure adjacent the fitment 302 and may help to align the fitment relative to the base of the container. A second portion of each of the panels 322 between the first 320 and third 324 portions of each of the panels may remain substantially unexpanded. The unexpanded second portions may form a substantially cylindrical portion of the container because of the shape of the expanded first and third portions of the container. It will be appreciated that the unexpanded second portions remain substantially flat and that they are merely held in the cylindrical configuration by expanded portions of the container.

The fitment 302 may include a cylindrical base 304 that is sealed to the first end of the tube-like structure with the remainder 306 of the fitment extending away from the tube-like structure. The term "cylindrical base" as applied to fitments is used to mean that the sealing surface (or "base") of a cylindrical base style fitment is preferably (but not necessarily) substantially parallel to the axis of the fitment but does not include external corners at sharply acute angles around its circumference. Rather, the circumference is preferably comprised of smooth and preferably convex curves. Having the circumference comprised of smooth curves is intended to facilitate the sealing of web material to the base of the fitment. The cross sectional shape of the sealing area of a cylindrical base fitment is preferably circular, but may be oval, or have some other curved shape. It should be understood that the fitment may be tapered somewhat (axially) to facilitate insertion or for other reasons. Alternatively, instead of the sealing surface area of a cylindrical base fitment being comprised of smooth curves, the sealing surface of a cylindrical base fitment may include intersections at an angle. Intersection angles that are greater than about 60 degrees, as might be used with a three-sided container, are generally satisfactory. The base of a cylindrical base style of fitment could, for example, have a triangular shape (in cross section).

The expansion may tend to thin the film of the panels 110 in the areas that are expanded. This thinning may lessen the effectiveness of an oxygen barrier material within the laminations of a laminated sheet of plastic film used to form some or all of the panels. Selectively expanding the panels may control the loss of effectiveness of the oxygen barrier material to acceptable levels.

Figure 2:
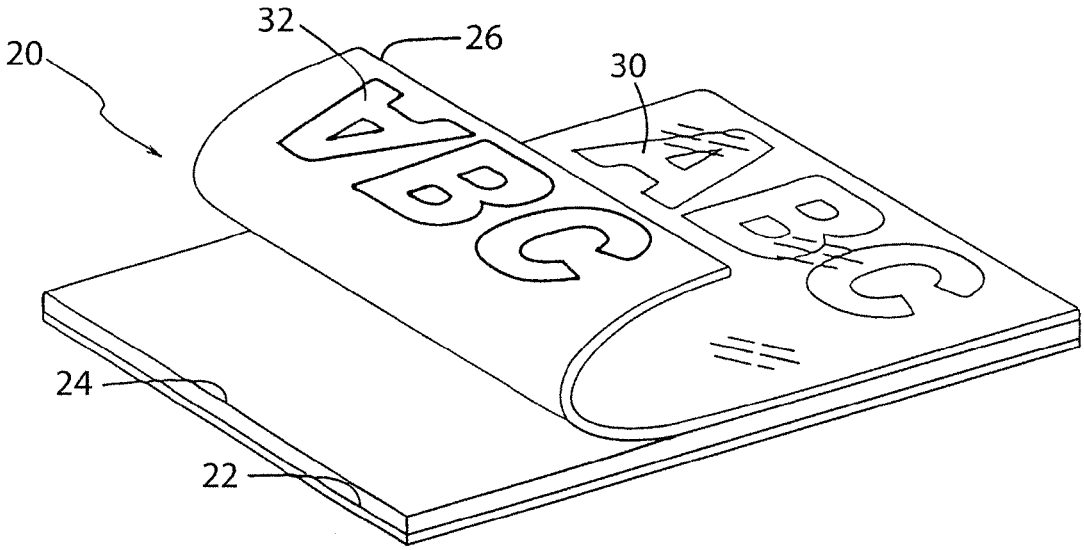
FIG. 2 is a perspective view of another laminate film including printed matter that may be used in an embodiment of the present invention.
Figure 9:
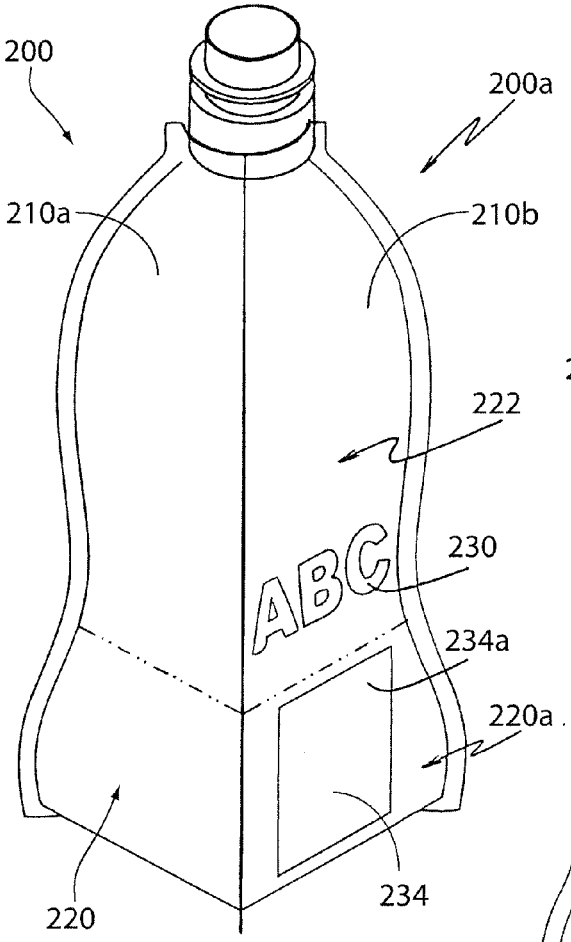
FIG. 9 is a perspective view of another container in an intermediate stage of construction.

As illustrated by FIGS. 9 and 10, printed matter may be added to one or more of the plastic film panels 210 that form the container 200. As shown in FIG. 2, the panels of plastic film that form the container may be laminated sheets 20 that include the printed matter 30 within the laminations with a clear layer 26 providing a protective layer over the printed matter. An oxygen barrier layer 24 and a bonding layer 22, which may be opaque, may be below the printed matter 30. The printed matter 32 may be printed as a mirror image on an inner surface of the transparent layer 26 of the laminated sheet 20. Dimensionally critical printed matter 230 may be located within the second portion 222 of the panel 210*b* that is left substantially unexpanded and remains substantially flat thus minimizing distortion of the critical printed matter, such as a bar code. Non-critical printed matter 234 may be located within the first portion 220 of the panel 210*b* that is expanded in the finished container 200*b*. It will be appreciated that the printed matter within a portion of the container that is expanded will become distorted. The unexpanded printed matter 220*a* may be prepared with a compensating distortion to reduce the apparent distortion in the expanded printed matter 220*b*.

A container that embodies the present invention may be made by providing a fitment that may include a resealable closure. A tube-like structure may be formed by joining a plurality of panels of plastic film by joining longitudinal edges of each panel to longitudinal edges of adjacent panels to form outwardly extending seams. A first end of the tube-like structure may be sealed to the fitment. The fitment may include a cylindrical base and the first end of the tube-like structure may be sealed to the cylindrical base with the remainder of the fitment means extending away from the tube-like structure. A second end of the tube-like structure opposite the first end may be closed by forming seams joining adjacent panels.

A first portion of each of the panels adjacent the second end of the tube-like structure may be expanded by confining at least the panels of the container in a mold and introducing a heated fluid into the container to expand the plastic film of the panels to fill the mold. The mold is such that the first portion of each of the panels is not flat after expansion while a second portion of each of the panels between the first end and the second end is left substantially unexpanded such that the second portion of each of the panels is substantially flat. A third portion of each of the panels adjacent the first end of the tube-like structure may be expanded such that the third portion of each of the panels is not flat.

A plurality of layers including an oxygen barrier material may be laminated to form the plastic film used to form the container. Printer matter may be applied within the laminations on at least one of the plurality of panels of plastic film. The printed matter may include dimensionally critical printed matter that is applied within the second portion of the panel.

The printed matter may be applied as a mirror image on an inner surface of a transparent layer of the laminated sheet.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A container comprising:

a fitment; and a plurality of panels of plastic film, each of the panels having a pair of opposing longitudinal edges, each longitudinal edge of each panel being joined to a longitudinal edge of an adjacent panel to form an outwardly extending seam, the panels collectively forming a tube-like structure, a first end of the tube-like structure being sealed to the fitment, and an opposing second end of the tube-like structure being closed by seams joining adjacent panels to define a base for supporting the container in a free-standing upright position on a flat surface, a first portion of each of the panels adjacent the second end of the tube-like structure being expanded such that the first portion of each of the panels is not flat when the container stands in the upright position, and a second portion of each of the panels between the first end and the second end being left substantially unexpanded such that the second portion of each of the panels is substantially flat when the container stands in the upright position.

2. The container of claim 1, wherein at least one of the plurality of panels of plastic film is a laminated sheet that includes printed matter within the laminations.

3. The container of claim 2, wherein the printed matter includes dimensionally critical printed matter within the second portion of the panel.

4. The container of claim 2, wherein the printed matter is printed as a mirror image on an inner surface of a transparent layer of the laminated sheet.

5. The container of claim 1, wherein a third portion of each of the panels adjacent the first end of the tube-like structure is expanded such that the third portion of each of the panels is not flat.

6. The container of claim 1, wherein the second end of the tube-like structure further defines the bottom of a liquid containment chamber extending continuously from the fitment to the base.

7. A container comprising:

a fitment; and a plurality of panels of plastic film, each of the panels having a pair of opposing longitudinal edges, each longitudinal edge of each panel being joined to a longitudinal edge of an adjacent panel to form an outwardly extending seam, the panels collectively forming a tube-like structure, a first end of the tube-like structure being sealed to the fitment, and an opposing second end of the tube-like structure being closed by seams joining adjacent panels to define the bottom of a liquid containment chamber extending continuously from the fitment to the second end of the tube-like structure, a first portion of each of the panels adjacent the second end of the tube-like structure being expanded such that the first portion of each of the panels is not flat, and a second portion of each of the panels between the first end and the second end being left substantially unexpanded such that the second portion of each of the panels is substantially fiat.

* * * * *